US010023270B2

(12) United States Patent
Park et al.

(10) Patent No.: US 10,023,270 B2
(45) Date of Patent: Jul. 17, 2018

(54) HEAT-INSULATION SYSTEM FOR LIQUEFIED NATURAL GAS CARGO HOLD

(71) Applicant: DAEWOO SHIPBUILDING & MARINE ENGINEERING CO., LTD., Seoul (KR)

(72) Inventors: Kwang Jun Park, Busan (KR); Joong Kyoo Kang, Geoje-si (KR)

(73) Assignee: DAEWOO SHIPBUILDING & MARINE ENGINEERING CO., LTD., Seoul (KR)

( * ) Notice: Subject to any disclaimer, the term of this patent is extended or adjusted under 35 U.S.C. 154(b) by 0 days.

(21) Appl. No.: 15/513,135

(22) PCT Filed: Sep. 3, 2015

(86) PCT No.: PCT/KR2015/009271
§ 371 (c)(1),
(2) Date: Mar. 21, 2017

(87) PCT Pub. No.: WO2016/047934
PCT Pub. Date: Mar. 31, 2016

(65) Prior Publication Data

US 2017/0320549 A1 Nov. 9, 2017

(30) Foreign Application Priority Data

Sep. 22, 2014 (KR) ..... 10-2014-0125867

(51) Int. Cl.
*B63B 25/16* (2006.01)
*F17C 1/12* (2006.01)
(Continued)

(52) U.S. Cl.
CPC ..... *B63B 25/16* (2013.01); *B63B 9/06* (2013.01); *F17C 1/12* (2013.01); *F17C 3/027* (2013.01);
(Continued)

(58) Field of Classification Search
CPC ..... B63B 25/00; B63B 25/08; B63B 25/16; F17C 1/06; F17C 1/12
(Continued)

(56) References Cited

U.S. PATENT DOCUMENTS 3,399,800 A * 9/1968 Gilles ..... B63B 25/16 114/74 A
3,878,658 A * 4/1975 Davis ..... B63B 25/16 114/74 A

FOREIGN PATENT DOCUMENTS

KR 10-2009-0118227 A 11/2009
KR 10-2011-0012989 A 2/2011
(Continued)

OTHER PUBLICATIONS

International Search Report dated Nov. 24, 2015 of PCT/KR2015/009271 which is the parent application and its English translation—4 pages.

*Primary Examiner* — Lars A Olson
(74) *Attorney, Agent, or Firm* — Knobbe Martens Olson & Bear LLP

(57) ABSTRACT

Disclosed is a heat-insulation system for a liquefied natural gas cargo hold, which comprises a primary sealing wall, a secondary sealing wall, and a secondary heat-insulating layer, and is applied to a liquefied natural gas cargo hold. The heat-insulation system for a liquefied natural gas cargo hold comprises a collar stud installed on a line on the upper surface of the secondary heat-insulating layer where an anchor strip is installed.

10 Claims, 8 Drawing Sheets

(51) Int. Cl.
*B63B 9/06* (2006.01)
*F17C 3/02* (2006.01)
*F17C 3/04* (2006.01)

(52) U.S. Cl.
CPC ..... *F17C 3/04* (2013.01); *F17C 2203/03* (2013.01); *F17C 2209/221* (2013.01); *F17C 2221/033* (2013.01); *F17C 2260/01* (2013.01); *F17C 2270/0107* (2013.01)

(58) Field of Classification Search
USPC ..... 114/74 A; 52/408, 410, 506.02, 509, 52/512, 747.13
See application file for complete search history.

(56) References Cited

FOREIGN PATENT DOCUMENTS

| | | | |
|---|---|---|---|
| KR | 10-2012-0058171 | A | 6/2012 |
| KR | 10-2013-0045700 | A | 5/2013 |
| KR | 10-2014-0047279 | A | 4/2014 |

* cited by examiner

HEAT-INSULATION SYSTEM FOR LIQUEFIED NATURAL GAS CARGO HOLD

TECHNICAL FIELD

The present invention relates to a heat-insulation system for a liquefied natural gas cargo containment system, and more particularly, to a heat-insulation system for a liquefied natural gas cargo containment system including a secondary sealing wall disposed on a secondary heat-insulating wall.

BACKGROUND ART

With growing global interest in eco-friendly businesses, demand for clean fuel, which can replace existing energy sources such as petroleum and coal, is increasing. In this situation, natural gas is used in various fields as a main energy source having cleanliness, stability and convenience. Unlike in the US and Europe, where natural gas is directly supplied through pipelines, Korea introduced liquefied natural gas (LNG) obtained by liquefying natural gas at an extremely low temperature and has supplied LNG to consumers. Thus, the demand for a cargo containment system (CCS) for storing LNG is increasing along with the increase in domestic natural gas demand.

LNG is obtained by cooling natural gas to an extremely low temperature (about −163° C.) and is suitable for long-distance transportation by sea since LNG is significantly reduced in volume, as compared with natural gas in a gaseous state. LNG carriers are designed to carry liquefied gas to an onshore source of demand and, for this purpose, include a cargo containment system capable of withstanding ultra-low temperatures of LNG.

Such a cargo containment system is divided into an independent tank-type and a membrane-type depending on whether the weight of cargo is directly applied to an insulator. The membrane-type cargo containment system is divided into a GTT NO 96-type and a Mark III-type, and the independent tank-type cargo containment system is divided into an MOSS-type and an IHI-SPB-type. The GTT NO 96-type and GTT Mark III-type were formerly called a GT type and a TGZ type. After, in 1995, Gas Transport (GT) and Technigaz (TGZ) were renamed to GTT (Gaztransport & Technigaz), the GT type and the TGZ type have been referred to as the GTT NO 96-type and the GTT Mark III-type, respectively.

A membrane-type LNG cargo containment system consists of double bulkheads. Here, a primary sealing wall is mainly formed of metal. Typically, a primary sealing wall of a GTT NO 96-type cargo containment system is formed of Invar and a primary sealing wall of a GTT Mark III-type cargo containment system is formed of Steel Use Stainless (SUS). In addition, a secondary sealing wall of a GTT NO 96-type cargo containment system is formed of Invar and a secondary sealing wall of a GTT Mark III-type cargo containment system is formed of Triplex, which is a non-metal.

Invar and Triplex are materials that hardly undergo thermal deformation, whereas SUS is a material that is subject to relatively severe thermal deformation. Thus, unlike a sealing wall formed of Invar or Triplex, a sealing wall formed of SUS must have wrinkles to cope with heat shrinkage near −163° C., which is the temperature of LNG.

FIG. 1 is a schematic perspective view of a primary sealing wall of a GTT Mark III-type LNG cargo containment system.

Referring to FIG. 1, each side of the primary sealing wall 100 formed of SUS is welded to an upper surface of an anchor strip 500 secured to an upper surface of a primary heat-insulating layer 200. In the primary sealing wall 100, each of four sides is secured to the anchor strip 500 and there are no other securing points on the surface of the primary sealing wall. Thus, the primary sealing wall uniformly shrinks upon temperature decrease such that wrinkles formed on the primary sealing wall can function properly.

However, each side of a secondary sealing wall welded to an upper surface of an anchor strip is secured on an upper surface of a secondary heat-insulating layer, and the secondary sealing wall has other securing points connected to the primary sealing wall 100. Thus, the secondary sealing wall does not uniformly shrink upon temperature decrease such that wrinkles formed on the secondary sealing wall cannot function properly.

Therefore, although SUS has more competitive price than Invar and has superior advantages over Triplex in terms of air-tightness, a typical LNG cargo containment system has a problem in that the use of a secondary sealing wall formed of SUS is limited.

DISCLOSURE

Technical Problem

Embodiments of the present invention have been conceived to solve such a problem in the art and it is an aspect of the present invention to provide a heat-insulation system for a liquefied natural gas cargo containment system, which includes a collar stud disposed on a line on which an anchor strip is disposed.

FIG. 3 is a schematic perspective view of a preferable heat-insulation system for an LNG cargo containment system for preventing thermal deformation, and FIG. 4 is a side sectional view of the heat-insulation system of FIG. 3.

Referring to FIGS. 3 and 4, a secondary sealing wall 300 according to the present invention includes a first membrane 310 and a second membrane 320, wherein one side 311 and another side 312 of the first membrane 310 are welded to an upper surface of an anchor strip 500, and one side 321 of the second membrane 320 is welded to an upper surface of the first membrane 310 and another side 322 thereof is welded to the upper surface of the anchor strip 500.

The anchor strip 500 is also formed of SUS, which is a thermally deformable material. Since a central portion of the anchor strip 500 is not moved when the anchor strip 500 undergoes thermal deformation, it is most preferable that the sides of the membranes 310, 320 be welded to the central portion of the anchor strip 500 to cope with thermal deformation.

The other side 312 of the first membrane 310 and the other side 322 of the second membrane 320 may be welded to the central portion of the anchor strip 500. However, if the one side 311 of the first membrane 310 is welded to the central portion of the anchor strip 500, a welding line of the collar stud 600 is not flat.

In order for the liquefied natural gas cargo containment system requiring air-tightness and insulation performance to function properly, the membranes must be firmly secured. If the welding line of the collar stud is not flat, the membranes cannot be firmly secured.

Therefore, the present invention is aimed at providing a heat-insulation system for a liquefied natural gas cargo containment system, which is capable of flattening the welding line of the collar stud while solving welding problems which can occur when the collar stud is disposed on a line on which the anchor strip is disposed.

Technical Solution

In accordance with one aspect of the present invention, a heat-insulation system for a liquefied natural gas cargo containment system, which includes a primary sealing wall, a secondary sealing wall and a secondary heat-insulating layer includes: a collar stud disposed on a line on an upper surface of the secondary heat-insulating layer on which an anchor strip is disposed.

The collar stud may include: a horizontal portion disposed horizontal to the secondary heat-insulating layer; and a rod-shaped vertical portion vertically passing through the horizontal portion, wherein the vertical portion may pass through the secondary sealing wall, the secondary heat-insulating layer, and the primary sealing wall.

The horizontal portion may have a stepped portion formed on a lower surface thereof.

The collar stud may include a setting plate, wherein the setting plate may be disposed inside the secondary heat-insulating layer such that an upper surface of the setting plate is exposed to a surface of the secondary heat-insulating layer.

In accordance with another aspect of the present invention, there is provided a method of manufacturing a heat-insulation system for a liquefied natural gas cargo containment system including a primary sealing wall, a secondary sealing wall, and a secondary heat-insulating layer, wherein an anchor strip is disposed on the secondary heat-insulating layer to weld the secondary sealing wall thereto, and a collar stud is disposed on a line, on which the anchor strip is disposed, to connect the primary sealing wall to the secondary sealing wall.

The secondary sealing wall may include a first membrane and a second membrane, one side of the first membrane may be welded to an outer edge of an upper surface of the anchor strip, a side at the stepped portion of the second membrane may be welded to an upper surface of the first membrane, a vertical portion of the collar stud may pass through the secondary heat-insulating layer, the anchor strip, the first membrane, and the second membrane, and a horizontal portion of the collar stud may be welded to an upper surface of the second membrane.

The collar stud may include a setting plate disposed inside the secondary heat-insulating layer such that an upper surface of the setting plate is exposed to a surface of the secondary heat-insulating layer, the secondary sealing wall may further include a third membrane and a fourth membrane, and a vertex of each of the first to fourth membranes may be beveled.

The setting plate may be integrally formed with the horizontal portion of the collar stud and the vertical portion of the collar stud may be disposed perpendicular to the setting plate.

A beveled portion of each of the first to fourth membranes may be welded to an upper surface of the setting plate.

The heat-insulation system may further include an additional membrane for securing the first to fourth membranes, wherein the beveled portion of each of the first to fourth membranes is placed on the upper surface of the setting plate; the additional membrane is secured so as to cover the beveled portion of each of the first to fourth membranes; the vertical portion of the collar stud passes through the additional membrane and the setting plate; and the horizontal portion of the collar stud is welded to an upper surface of the additional membrane.

The additional membrane may have a stepped portion formed on a lower surface thereof.

Advantageous Effects

In the heat-insulation system for an LNG cargo containment system according to the present invention, since a securing point at which a secondary sealing wall is connected to a primary sealing wall, that is, a collar stud, is disposed on a line on which an anchor strip is disposed, there are no other securing points on a surface of the secondary sealing wall apart from four sides of the secondary sealing wall. Accordingly, the secondary sealing wall uniformly shrinks upon temperature decrease, whereby wrinkles formed on the secondary sealing wall can function properly.

That is, since the collar stud is placed on the line on which the anchor strip is disposed, the secondary sealing wall can be prepared against thermal deformation and formed of SUS, whereby the liquefied natural gas cargo containment system with high air-tightness and competitive price can be manufactured.

In addition, in the heat-insulation system according to the present invention, not only when two membranes are arranged around the collar stud but also when four membranes are arranged, a welding line can be flattened, thereby allowing the membranes to be firmly secured.

EMBODIMENTS

Hereinafter, embodiments of the present invention will be described with reference to the accompanying drawings. A heat-insulation system for an LNG cargo containment system according to the following embodiments may be installed in all marine structures designed for LNG transportation. In addition, it should be understood that the present invention is not limited to the following embodiments, and that various modifications, substitutions, and equivalent embodiments can be made by those skilled in the art without departing from the spirit and scope of the present invention.

Figure 1:
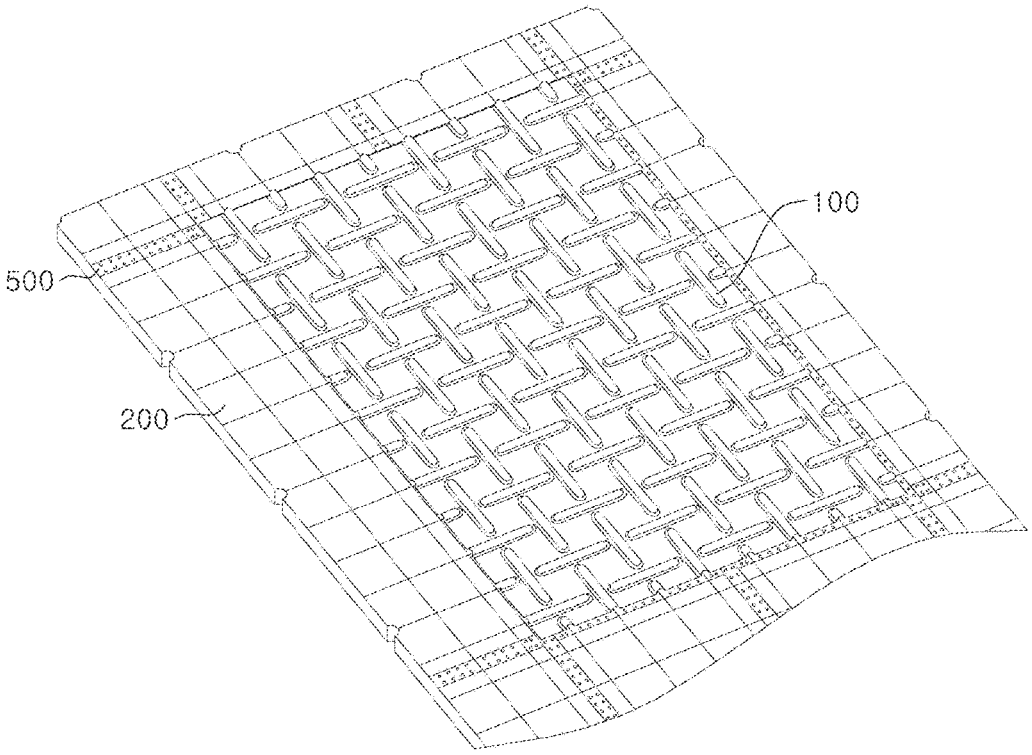
PRIOR ART FIG.1
FIG. 1 is a schematic perspective view of a primary sealing wall of a liquefied natural gas cargo containment system.
Figure 2:
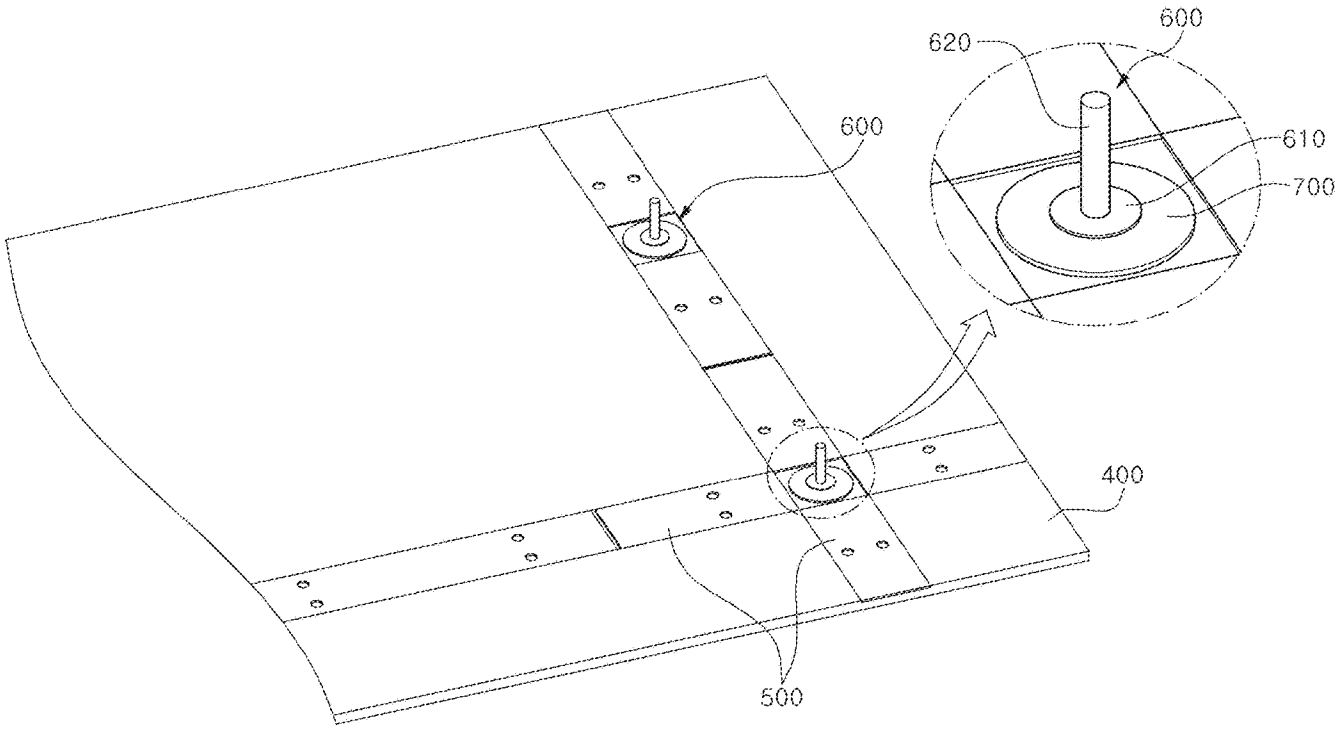
FIG. 2 is a schematic perspective view of a heat-insulation system for an LNG cargo containment system according to an exemplary embodiment of the present invention.
Figure 3:
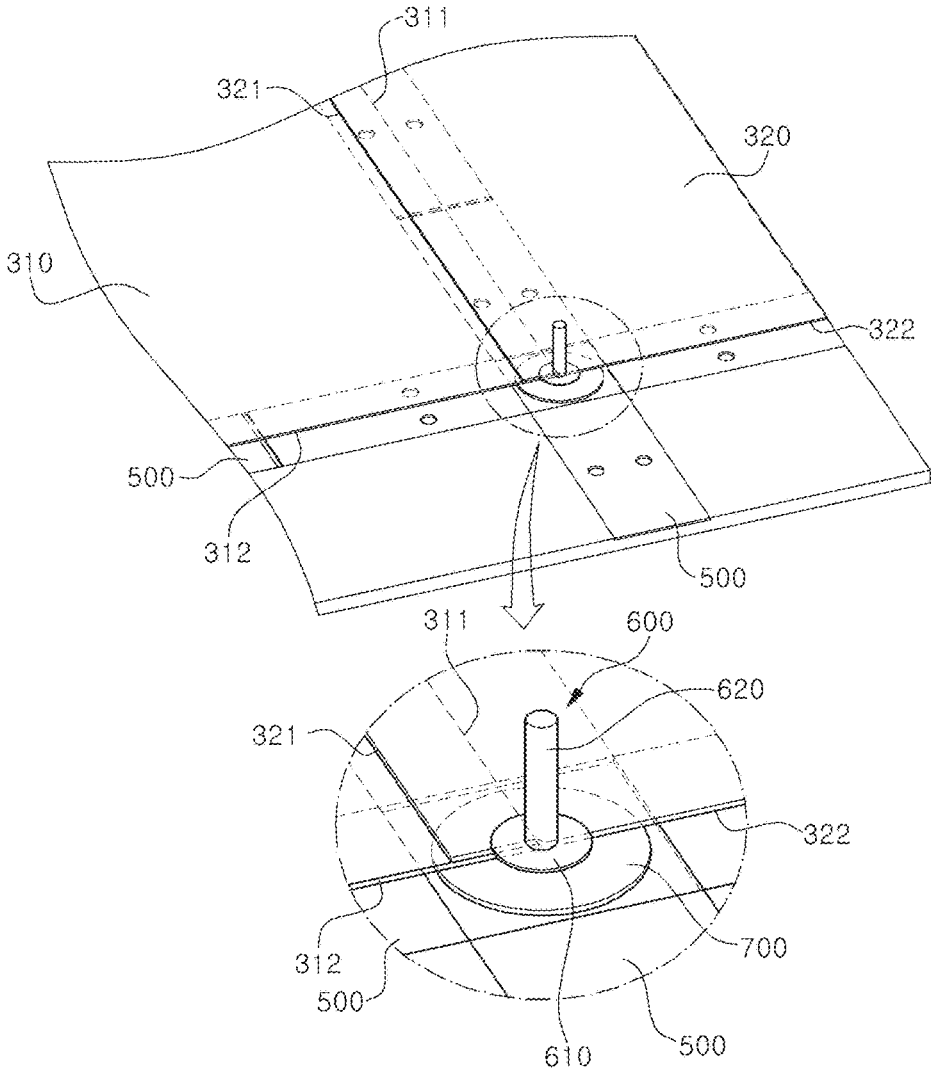
FIG. 3 is a schematic perspective view of a preferable heat-insulation system for an LNG cargo containment system, which can cope with thermal deformation.
Figure 4:
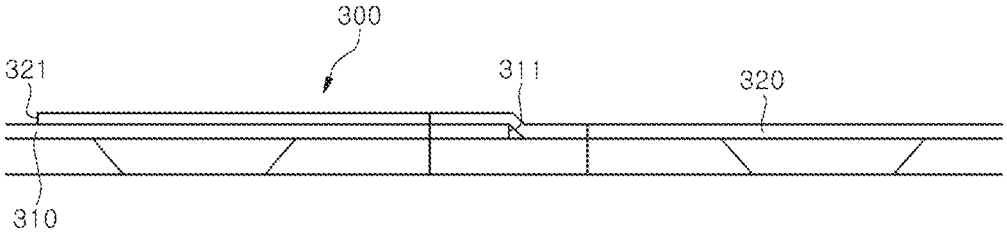
FIG. 4 is a side sectional view of the heat-insulation system of FIG. 3.

FIG. 2 is a schematic perspective view of a heat-insulation system for an LNG cargo containment system according to an exemplary embodiment of the present invention.

Referring to FIG. 2, a heat-insulation system for an LNG cargo containment system according to an exemplary embodiment of the present invention includes: an anchor strip 500 disposed on a secondary heat-insulating layer 400; a collar stud 600 disposed on a line on which the anchor strip is disposed; and a setting plate 700 disposed under the collar stud 600. The setting plate 700 may have a circular shape, as shown in FIG. 2, or may have a square shape.

Generally, the LNG cargo containment system is manufactured through a process in which the secondary heat-insulating layer 400 is disposed on a hull, a secondary sealing wall 300 is disposed on the secondary heat-insulating layer 400, a primary heat-insulating layer 200 is disposed on the secondary sealing wall 300, and a primary sealing wall 100 is disposed on the primary heat-insulating layer 200. Each of the primary sealing wall 100 and the secondary sealing wall 300 is formed of a plurality of membranes.

The anchor strip 500 is a strip-shaped piece of metal having a thickness of about 0.7 mm and may be formed of SUS or the like. The anchor strip 500 is disposed on both the primary heat-insulating layer 200 and the secondary heat-insulating layer 400 to weld the membranes thereto. The anchor strip 500 is disposed at predetermined intervals depending on the size of the membrane such that four sides of the membrane can be welded to an upper surface of the anchor strip 500.

Since the anchor strip 500 can undergo thermal deformation like the membrane, it is desirable that the sides of the membrane be welded to a central portion of the anchor strip 500.

The collar stud 600 includes a horizontal portion 610 disposed horizontal to the secondary heat-insulating layer 400; and a rod-shaped vertical portion 620 vertically passing through the horizontal portion 610.

The horizontal portion 610 serves to support the collar stud 600 to be stably mounted and a stepped portion may be formed on a lower surface of the horizontal portion 610 to flatten a welding surface of the horizontal portion 610.

The vertical portion 620 serves to connect the secondary heat-insulating layer 400, the secondary sealing wall 300, the primary heat-insulating layer 200, and the primary sealing wall 100 to one another. That is, a lower end of the vertical portion 620 is connected to the secondary heat-insulating layer 400, an upper end of the vertical portion 620 is connected to the primary sealing wall 100, and the secondary sealing wall 300 and the primary heat-insulating layer 200 between the secondary heat-insulating layer 400 and the primary sealing wall 100 are both penetrated by the vertical portion 620.

The setting plate 700 is disposed inside the secondary heat-insulating layer 400 such that an upper surface of the setting plate 700 is exposed to the surface of the secondary heat-insulating layer. Here, the upper surface of the setting plate 700 may be substantially flush with the secondary heat-insulating layer 400. In addition, the setting plate 700 is disposed on a line of the anchor strip 500 and may be formed of metal to weld the membrane or the horizontal portion 610 of the collar stud 600 to the upper surface thereof.

In the heat-insulation system for an LNG cargo containment system according to this embodiment, since securing points of the secondary sealing wall 300 are all located at four sides of the secondary sealing wall on the line of the anchor strip 500 and there is no securing point on the surface of the secondary sealing wall 300, the membrane can uniformly expand or shrink when undergoing thermal deformation, whereby wrinkles formed in the membrane can function properly.

Figure 5:
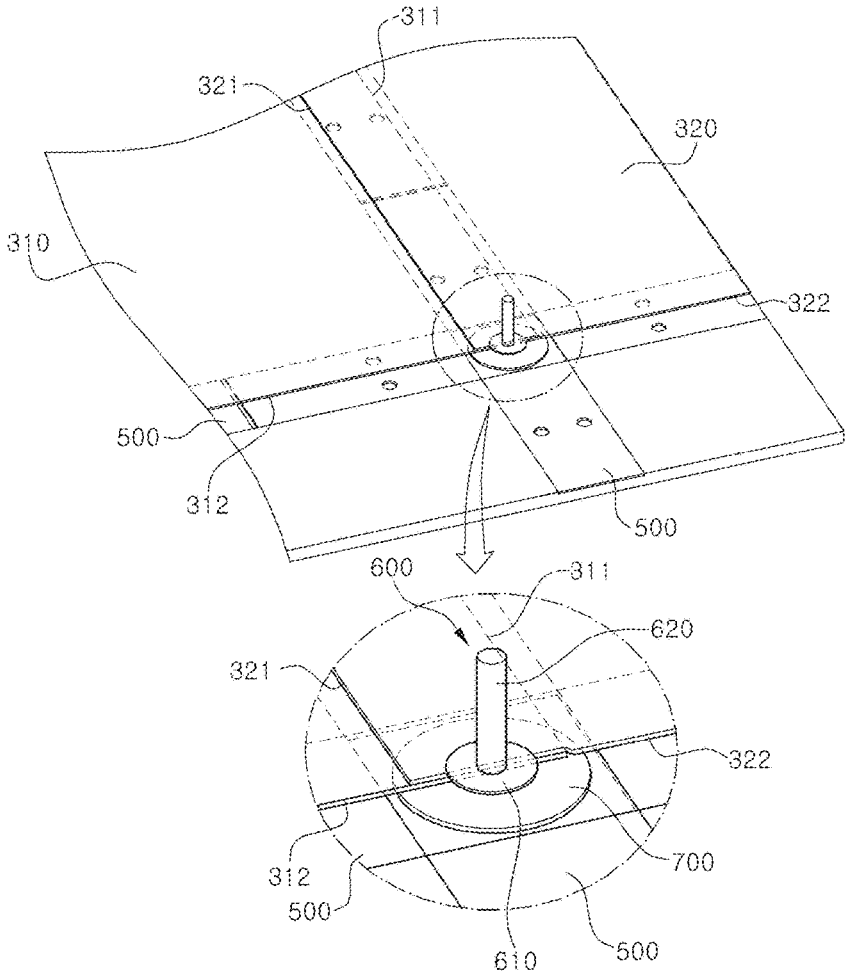
FIG. 5 is a schematic perspective view of a heat-insulation system for an LNG cargo containment system according to a first embodiment of the present invention.
Figure 6:
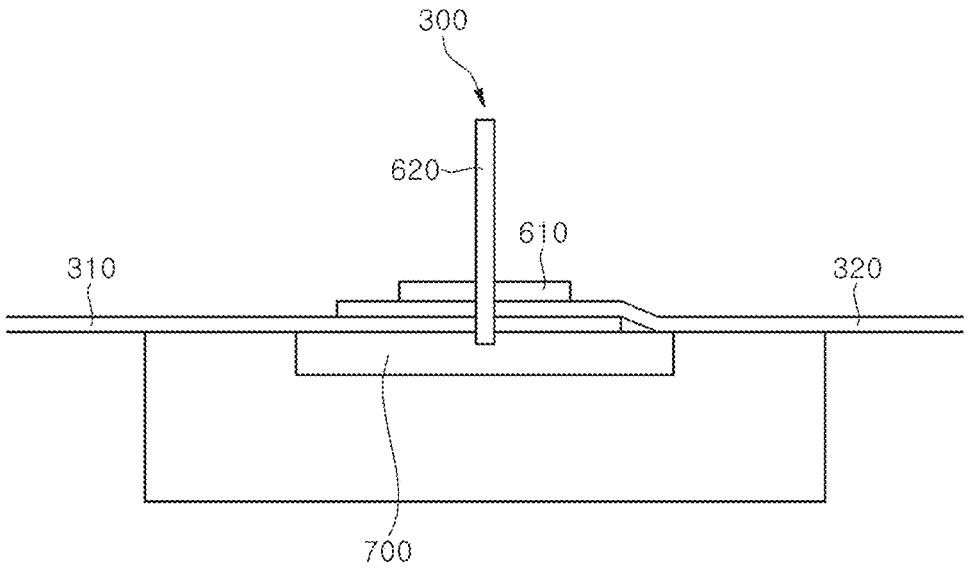
FIG. 6 is a side sectional view of the heat-insulation system of FIG. 5.

FIG. 5 is a schematic perspective view of a heat-insulation system for an LNG cargo containment system according to a first embodiment of the present invention and FIG. 6 is a side sectional view of the heat-insulation system of FIG. 5.

Referring to FIGS. 5 and 6, a method for manufacturing the heat-insulation system for an LNG cargo containment system according to this embodiment includes: welding one side 311 of a first membrane 310 to an outer edge of an upper surface of an anchor strip 500 and welding another side 312 of the first membrane 310 to a central portion of the upper surface of the anchor strip 500; forming a stepped portion having the same height as the first membrane 310 at one edge of the second membrane 320; placing one edge of the first membrane 310 under the stepped portion of the second membrane 320 and welding one side 321 of the second membrane 320 to an upper surface of the first membrane 310; welding another side 322 of the second membrane 320 to the central portion of the upper surface of the anchor strip 500; placing a collar stud 600 such that a vertical portion 620 passes through the secondary heat-insulating layer 400, the first membrane 310, and the second membrane 320, and a lower surface of a horizontal portion 610 adjoins an upper surface of the stepped portion of the second membrane 320; and welding the horizontal portion 610 of the collar stud 600 to the upper surface of the stepped portion of the second membrane 320.

Since the other side 312 of the first membrane 310 is welded to the outer edge of the upper surface of the anchor strip 500 instead of the central portion of the upper surface of the anchor strip, both one edge of the second membrane 320 and one edge of the first membrane 310 are located vertically under the horizontal portion 610 of the collar stud 600. Accordingly, the welding surface of the horizontal portion 610 of the collar stud 600 can be flat.

A stepped portion may be formed on a lower surface of the horizontal portion 610 of the collar stud 600 such that a welding line of the horizontal portion 610 can be flat.

Figure 7:
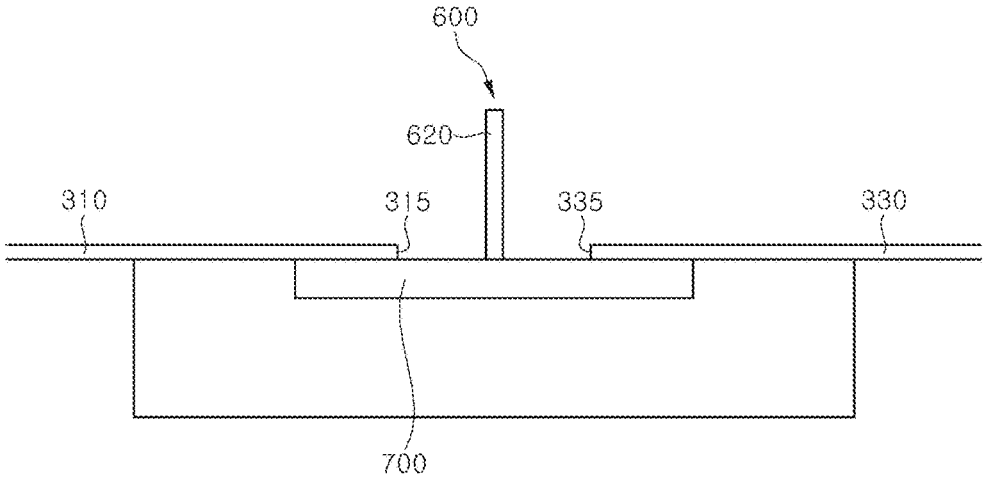
FIG. 7 is a schematic side sectional view of a heat-insulation system for an LNG cargo containment system according to a second embodiment of the present invention.
Figure 8:
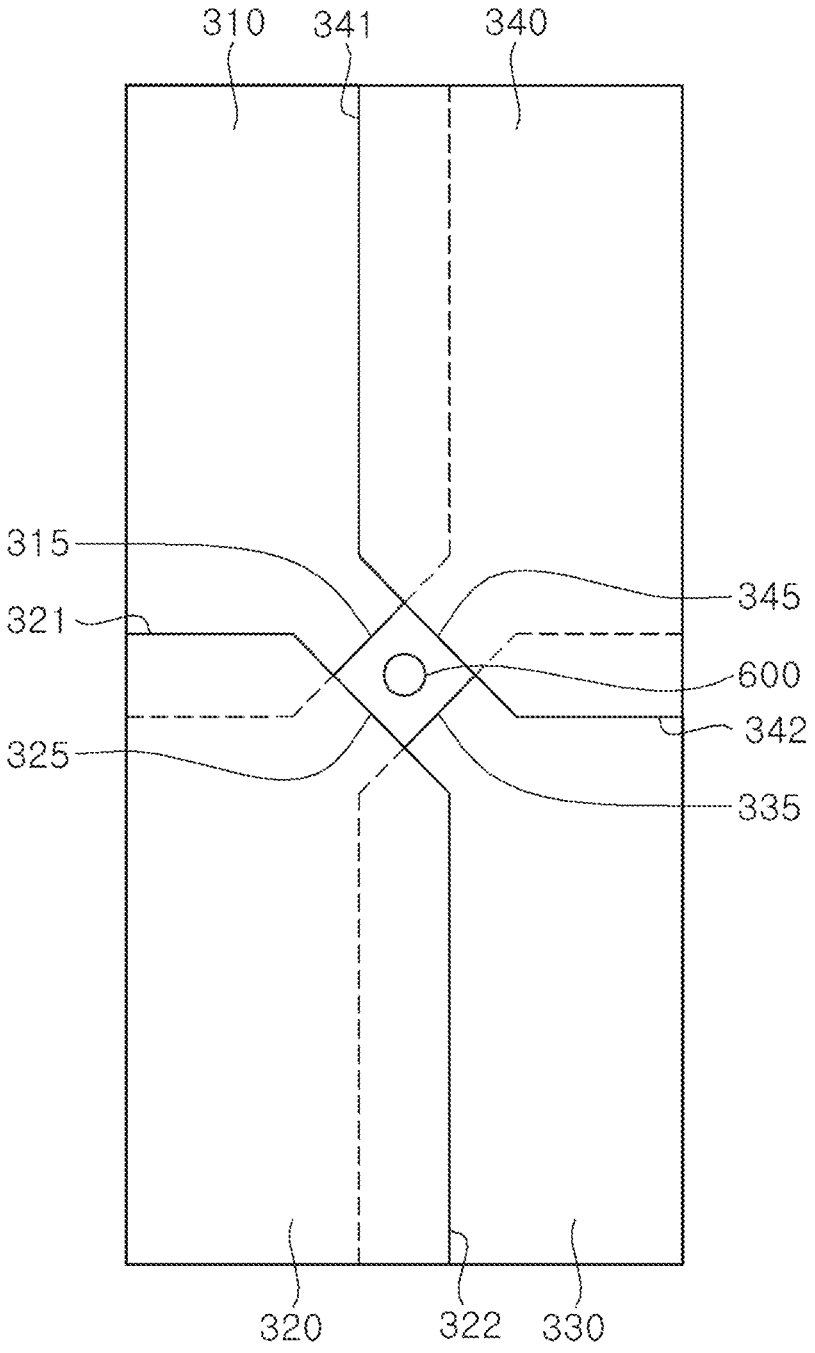
FIG. 8 is a plan view of the heat-insulation system of FIG. 7.

FIG. 7 is a schematic side sectional view of a heat-insulation system for an LNG cargo containment system according to a second embodiment of the present invention and FIG. 8 is a plan view of the heat-insulation system of FIG. 7.

Referring to FIGS. 7 and 8, a method for manufacturing the heat-insulation system for an LNG cargo containment system according to this embodiment includes: beveling a vertex 315, 325, 335 or 345 of each of first to fourth membranes 310, 320, 330, 340; disposing a vertical portion 620 of a collar stud 600 perpendicular to a setting plate 700; welding each side of the first membrane 310 to an upper surface of an anchor strip 500 and welding a beveled portion 315 at the vertex of the first membrane 310 to an upper surface of the setting plate 700; placing the third membrane 330 diagonally opposite the first membrane 310; welding each side of the third membrane 330 to the upper surface of the anchor strip 500 and welding a beveled portion 335 at the vertex of the third membrane 330 to the upper surface of the setting plate 700; welding one side 321 of the second membrane 320 to an upper surface of the first membrane 310, welding another side 322 of the second membrane 320 to an upper surface of the third membrane 330, and welding a beveled portion 325 at the vertex of the second membrane 320 to the upper surfaces of the first membrane 310, the setting plate 700, and the third membrane 330; and welding one side 341 of the fourth membrane 340 to the upper surface of the first membrane 310, welding another side 342 of the fourth membrane 340 to the upper surface of the third membrane 330, and welding a beveled portion 345 at the vertex of the fourth membrane 340 to the upper surfaces of the first membrane 310, the setting plate 700 and the third membrane 330.

In this embodiment, a horizontal portion 610 of the collar stud 600 is formed integrally with the setting plate 700 and a vertex of each of the membranes 310, 320, 330, and 340 is beveled such that the beveled portion 315, 325, 335, or 345 at the vertex of each of the membranes 310, 320, 330, 340 can be directly welded to the upper surface of the setting plate 700. According to this embodiment, even when the collar stud is disposed on a line on which the anchor strip is disposed and four membranes are arranged to overlap one another, the membranes can be firmly secured.

A stepped portion having a height substantially equal to the height of an underlying membrane 310 or 330 may be formed at each of a portion of the second membrane 320 overlapping the first membrane 310 or the third membrane 330 and a portion of the fourth membrane 340 overlapping the first membrane 310 or the third membrane 330. In addition, one edge of the first membrane 310 or one edge of the third membrane 330 may be located under the stepped portion of each of the second membrane 320 and the fourth membrane 340.

Each side of the first membrane 310 and the third membrane 330 may be welded to the central portion of the anchor strip 500 to be less affected even when the anchor strip 500 is deformed by heat.

Although the second membrane 320 and the fourth membrane 340 are welded after the first membrane 310 and the third membrane 330 are welded in this embodiment, it should be understood that the present invention is not limited thereto and the order in which the membranes are welded may vary. In addition, a stepped portion may be appropriately formed according to the order in which the membranes are welded.

Figure 9:
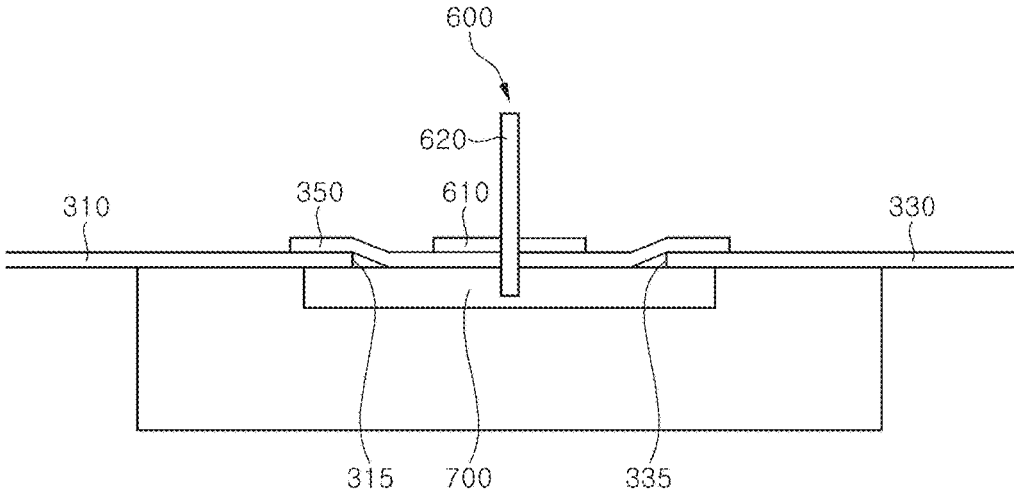
FIG. 9 is a schematic side sectional view of a heat-insulation system for an LNG cargo containment system according to a third embodiment of the present invention.
Figure 10:
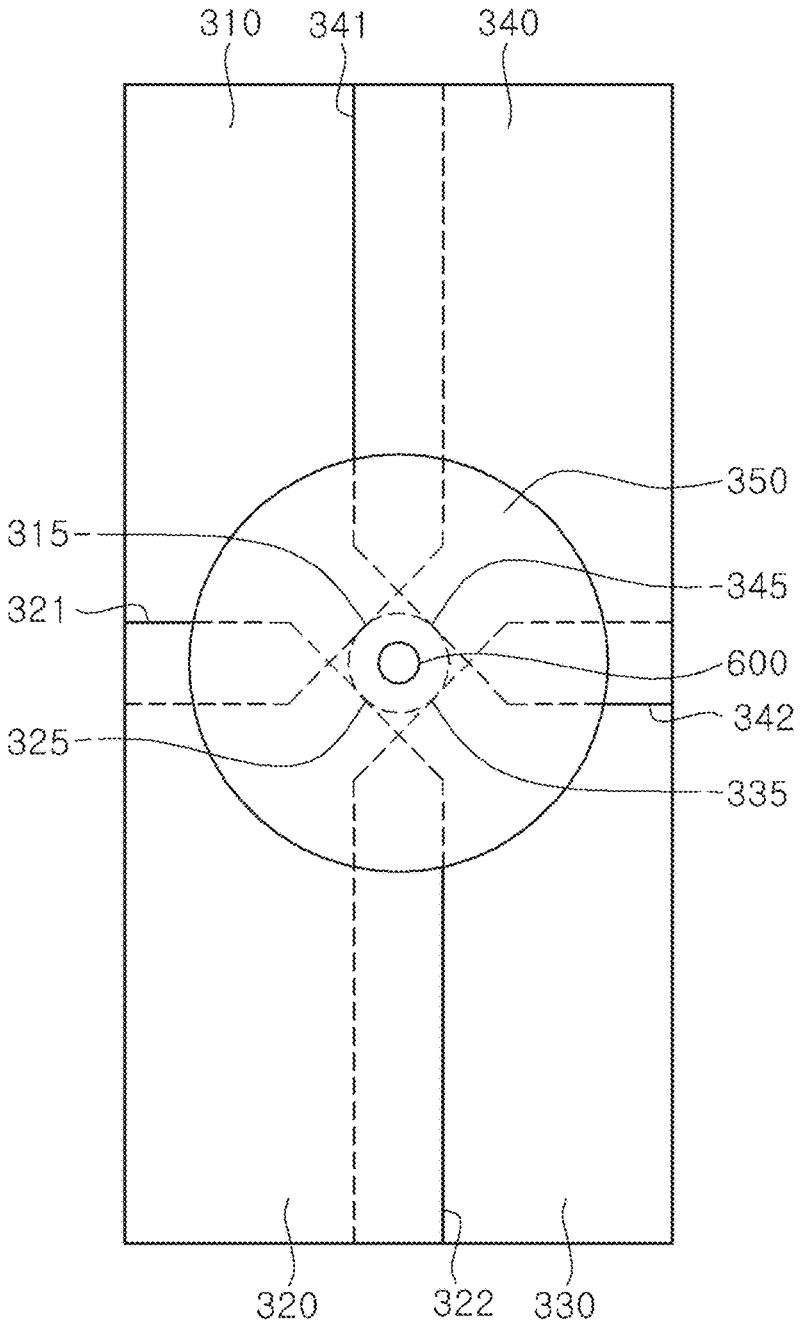
FIG. 10 is a plan view of the heat-insulation system of FIG. 9.

FIG. 9 is a schematic side sectional view of a heat-insulation system for an LNG cargo containment system according to a third embodiment of the present invention and FIG. 10 is a plan view of the heat-insulation system of FIG. 9.

Referring to FIGS. 9 and 10, a method for manufacturing the heat-insulation system for an LNG cargo containment system according to this embodiment includes: beveling a vertex 315, 325, 335, or 345 of each of first to fourth membranes 310, 320, 330, 340; placing a beveled portion 315 at the vertex where the first membrane 310 meets an upper surface of a setting plate 700 and welding each side of the first membrane 310 to an upper surface of an anchor strip 500; placing the third membrane 330 diagonally opposite the first membrane 310 such that a beveled portion 335 at the vertex of the third membrane 330 is located on the upper surface of the setting plate 700; welding each side of the third membrane 330 to the upper surface of the anchor strip 500; placing a beveled portion 325 at the vertex of the second membrane 320 on the upper surface of the setting plate 700, welding one side 321 of the second membrane 320 to an upper surface of the first membrane 310, and welding another side 322 of the second membrane 320 to an upper surface of the third membrane 330; placing a beveled portion 345 at the vertex of the fourth membrane 340 on the upper surface of the setting plate 700, welding one side 341 of the fourth membrane 340 to the upper surface of the first membrane 310, and welding another side 342 of the fourth membrane 340 to the upper surface of the third membrane 330; placing an additional membrane 350 such that a lower surface of the additional membrane adjoins the first to fourth membranes 310, 320, 330, 340 and the setting plate 700; welding an edge of the additional membrane 350 to the upper surfaces of the first to fourth membranes 310, 320, 330, 340; placing a collar stud 600 such that a vertical portion 620 passes through the additional membrane 350 and the setting plate 700 and a lower surface of a horizontal portion 610 adjoins the lower surface of the additional membrane 350; and welding an edge of the horizontal portion 610 of the collar stud 600 to an upper surface of the additional membrane 350.

Like in the heat-insulation system for an LNG cargo containment system according to the second embodiment, in the heat-insulation system for an LNG cargo containment system according to this embodiment, even when the collar stud is disposed on a line on which the anchor strip is disposed and four membranes are arranged to overlap one another, the membranes can be firmly secured.

However, unlike the method for manufacturing the heat-insulation system for an LNG cargo containment system according to the second embodiment, the method for manufacturing the heat-insulation system for an LNG cargo containment system according to this embodiment does not include disposing the vertical portion 620 of the collar stud 600 perpendicular to the setting plate 700. That is, the heat-insulation system for an LNG cargo containment system according to this embodiment includes the collar stud 610 including the horizontal portion 610 and the vertical portion 620 and the separate setting plate 700 rather than including the collar stud 600, the horizontal portion 610 of which is formed integrally with the setting plate 700.

In addition, unlike the heat-insulation system for an LNG cargo containment system according to the second embodiment, the heat-insulation system for an LNG cargo containment system according to this embodiment further includes the additional membrane 350 without the beveled portion 315, 325, 335, or 345 at a vertex of each of the membranes being welded to the upper surface of the setting plate 700, wherein the additional membrane 350 is welded to the upper surfaces of the first membrane 310 to the fourth membrane 340, followed by welding the horizontal portion 610 of the collar stud 600 to the upper surface of the additional membrane 350 to secure the membranes 310, 320, 330, 340.

As in the heat-insulation system according to the second embodiment, in the heat-insulation system according to this embodiment, a stepped portion having a height substantially equal to the height of an underlying membrane 310 or 330 may be formed at each of a portion of the second membrane 320 overlapping the first membrane 310 or the third membrane 330 and a portion of the fourth membrane 340 overlapping the first membrane 310 or the third membrane 330. In addition, one edge of the first membrane 310 or one edge of the third membrane 330 may be located under the stepped portion of each of the second membrane 320 and the fourth membrane 340.

Each side of each of the first membrane 310 and the third membrane 330 may be welded to the central portion of the anchor strip 500 to be less affected even when the anchor strip 500 is deformed by heat.

Further, a stepped portion may be formed on a lower surface of the additional membrane 350 such that a welding line of the additional membrane can be flat.

Although some embodiments have been described herein, it should be understood that these embodiments are provided for illustration only and are not to be construed in any way as limiting the present invention, and that various modifications, changes, alterations, and equivalent embodiments can be made by those skilled in the art without departing from the spirit and scope of the invention.

The invention claimed is:

1. A ship having a heat-insulation system for a liquefied natural gas cargo containment system comprising a primary sealing wall, a secondary sealing wall, and a secondary heat-insulating layer, the heat-insulation system comprising: a collar stud disposed on a line on an upper surface of the secondary heat-insulating layer on which an anchor strip is disposed, wherein the collar stud comprises a horizontal portion disposed horizontal to the secondary heat-insulating layer, wherein the horizontal portion has a stepped portion formed on a lower surface thereof.

2. The ship according to claim 1, wherein the collar stud comprises:

a rod-shaped vertical portion vertically passing through the horizontal portion.

3. A ship having a heat-insulation system for a liquefied natural gas (LNG) cargo containment system comprising a primary sealing wall, a secondary sealing wall, and a secondary heat-insulating layer, the heat-insulation system comprising a collar stud disposed on a line on an upper surface of the secondary heat-insulating layer on which an anchor strip is disposed, wherein the collar stud comprises a horizontal portion disposed horizontal to the secondary heat-insulating layer, wherein the collar stud further comprises a rod-shaped vertical portion vertically passing through the horizontal portion, the vertical portion passing through the secondary sealing wall, the secondary heat-insulating layer, and the primary sealing wall, wherein the horizontal portion has a stepped portion formed on a lower surface thereof.

4. A method of manufacturing a ship having a heat-insulation system for a liquefied natural gas (LNG) cargo containment system comprising a primary sealing wall, secondary sealing wall, and a secondary heat-insulating layer, wherein an anchor strip is disposed on the secondary heat-insulating layer to weld the secondary sealing wall thereto, wherein a collar stud is disposed on a line, on which the anchor strip is disposed, to connect the primary sealing wall to the secondary sealing wall, wherein the secondary sealing wall comprises a first membrane and a second membrane, one side of the first membrane is welded to an outer edge of an upper surface of the anchor strip, a side at the stepped portion of the second membrane is welded to an upper surface of the first membrane, a vertical portion of the collar stud passes through the secondary heat-insulating layer, the anchor strip, the first membrane, and the second membrane, and a horizontal portion of the collar stud is welded to an upper surface of the second membrane.

5. The method according to claim 4, wherein the collar stud comprises a setting plate disposed inside the secondary heat-insulating layer such that an upper surface of the setting plate is exposed to a surface of the secondary heat-insulating layer, the secondary sealing wall further comprises a third membrane and a fourth membrane, and a vertex of each of the first to fourth membranes is beveled.

6. The method according to claim 5, wherein the setting plate is integrally formed with the horizontal portion of the collar stud and the vertical portion of the collar stud is disposed perpendicular to the setting plate.

7. The method according to claim 6, wherein a beveled portion of each of the first to fourth membranes is welded to an upper surface of the setting plate.

8. The method according to claim 5, wherein the heat-insulation system further comprises an additional membrane for securing the first to fourth membranes, and wherein the beveled portion of each of the first to fourth membranes, is placed on the upper surface of the setting plate; the additional membrane is secured so as to cover the beveled portion of each of the first to fourth membranes; the vertical portion of the collar stud passes through the additional membrane and the setting plate; and the horizontal portion of the collar stud is welded to an upper surface of the additional membrane.

9. The method according to claim 8, wherein the additional membrane has a stepped portion formed on a lower surface thereof.

10. A ship comprising:

a primary sealing wall, a secondary sealing wall comprising a plurality of membrane pieces and a plurality of anchor strips, a primary heat-insulating layer interposed between the primary and secondary sealing walls, a secondary heat-insulating layer provided such that the secondary sealing wall is interposed between the primary and secondary heat-insulating layer, the plurality of membrane pieces comprising a first membrane piece and a second membrane piece abutting the first membrane piece, wherein the first membrane piece comprising a first edge and a first perimeter along the first edge, wherein the plurality of membrane pieces comprise a second edge and second perimeter along the second edge, the plurality of anchor strips comprising a first anchor strip and a second anchor strip arranged such that the first anchor strip and the second anchor strip extend generally along the first edge with a gap therebetween, the first anchor strip overlapping with a first portion of the first perimeter and further overlapping with a first portion of the second perimeter such that the first portion of the first perimeter and the first portion of the second perimeter overlap each other, such that a first portion of the first edge is under the first portion the second perimeter and further such that a first portion the second edge is over the first portion the first perimeter, the second anchor strip overlapping with a second portion of the first perimeter and further overlapping with a second portion of the second perimeter such that the second portion of the first perimeter and the second portion of the second perimeter overlap each other, such that a second portion of the first edge is under the second portion the second perimeter and further such that a second portion the second edge is over the second portion the first perimeter, and a collar stud comprising a horizontal portion and a vertical portion integrated with the horizontal portion, wherein the collar stud is installed in the gap between the first anchor strip and the second anchor strip such that the vertical portion passes through both the first perimeter and the second perimeter and such that the horizontal portion is placed over the second perimeter and welded to the second perimeter.

* * * * *